United States Patent [19]

Pollich

[11] Patent Number: 4,697,804

[45] Date of Patent: Oct. 6, 1987

[54] SHEET FEEDER FOR ROTARY PRINTING MACHINES

[75] Inventor: Gerhard Pollich, Heidelberg, Fed. Rep. of Germany

[73] Assignee: Heidelberger Druckmaschinen AG, Heidelberg, Fed. Rep. of Germany

[21] Appl. No.: 865,581

[22] Filed: May 16, 1986

Related U.S. Application Data

[63] Continuation of Ser. No. 621,516, Jun. 18, 1984, abandoned.

[30] Foreign Application Priority Data

Jun. 16, 1983 [DE] Fed. Rep. of Germany ..... 3321724

[51] Int. Cl.[4] ..... B65H 1/00

[52] U.S. Cl. ..... 271/162; 271/156; 271/164; 271/171; 414/35

[58] Field of Search ..... 271/5, 145, 147, 171, 271/152–163, 164; 414/35, 36, 70, 113, 118, 119

[56] References Cited

U.S. PATENT DOCUMENTS

| | | | |
|---|---|---|---|
| 808,019 | 12/1905 | Cross | 271/164 |
| 1,424,916 | 8/1922 | Kelly | 271/156 |
| 1,948,001 | 2/1934 | Mensman et al. | 271/164 |

FOREIGN PATENT DOCUMENTS

| | | | |
|---|---|---|---|
| 3321724 | 3/1984 | Fed. Rep. of Germany | 271/162 |
| 766221 | 1/1957 | United Kingdom | 271/159 |

*Primary Examiner*—Andres Kashnikow
*Assistant Examiner*—Matthew C. Graham
*Attorney, Agent, or Firm*—Herbert L. Lerner; Laurence A. Greenberg

[57] ABSTRACT

A sheet feeder for rotary printing machines having a horizontally movable support for a sheet pile, stops for laterally adjusting the sheet pile and vertically disposed guide rails in a forward region of the sheet pile for engaging the leading edge of the sheets, includes a device for mounting the guide rails so that they are freely movable laterally, and automatically follow a movement of the sheet pile.

4 Claims, 5 Drawing Figures

SHEET FEEDER FOR ROTARY PRINTING MACHINES

This application is a continuation of application Ser. No. 621,516, filed June 18, 1984, now abandoned.

The invention relates to a sheet feeder for rotary printing machines and, more particularly, to such a sheet feeder having a horizontally movable support for a sheet pile, stops for laterally adjusting the sheet pile and vertically disposed guide rails in a forward region of the sheet pile for engaging the leading edge of the sheets.

German Published Non-Prosecuted Application (DE-OS) 22 00 755 discloses a device for automatically adjusting or orienting a sheet pile wherein, stops are provided laterally for adjusting the sheet pile. In this regard, it is possible to feed in laterally adjusted condition to the sheet feeder, sheet piles which had been shifted, for example, transversely to the sheet travel direction. To this effect, the leading-edge or forward side of the sheet pile as viewed in travel direction of the sheets is brought into contact in-register with the guide rails. Even when the sheet pile is being lifted during operation of the machine, the remaining sheets in the pile will continue to be always in contact with the front guide rails until they are used up completely i.e. removed from the pile.

A disadvantage of heretofore known constructions of this general type has been that, due to the tight engagement or contact of the sheet pile with the front guide rails, a lateral movement thereof can be effected only by applying considerable force through the use of a separate motor. Furthermore, there is always a risk that individual overlapping or protruding sheet layers in the forward or leading-edge region of the sheet pile may become damaged due to the lateral movement of the sheet pile. In spite of the considerable expense for construction and control, it is not possible with the heretofore known devices of general type as that of the invention to effect a delicate or sensitive adjustment or orientation of the sheet pile in lateral direction.

It is accordingly an object of the invention to prove a device which will perform a lateral adjustment of the sheet pile in a sheet feeder of rotary printing machines with a relatively low technical expense, wherein a free lateral movement is possible with minimal expenditure of force, so that stops provided on both sides and serving for adjusting or orienting the sheet pile are adequate for the movement thereof, without having to fear that the leading edge of the sheet would be damaged by the guide rails.

With the foregoing and other objects in view, there is provided, in accordance with the invention, a sheet feeder for rotary printing machines having a horizontally movable support for a sheet pile, stops for laterally adjusting the sheet pile and vertically disposed guide rails in a forward region of the sheet pile for engaging the leading edge of the sheets, comprising means for mounting the guide rails so that they are freely movable laterally, and automatically follow a movement of the sheet pile.

Due to the lateral mobility of the support plate and the guide rails, an automatic adjustment of the sheet pile can thus be effected during operation of the machine, without requiring additional control means or greater forces therefor. Additionally, damage to the sheets is avoided thereby in a relatively simple manner.

In accordance with another feature of the invention, there are provided, strips connecting the guide rails to one another, the guide rails and the strips being jointly mounted via ball-bearing bushings on cross bars extending from side-to-side of the sheet feeder, and stop springs mounted on the cross bars at both ends thereof.

In accordance with a further feature of the invention, there are provided, strips connecting the guide rails to one another, and vertically extending leaf springs having an upper end at which the guide rails and the strips are jointly mounted, the leaf springs being fastened at respective lower ends thereof via pillow blocks to a frame of the sheet feeder and affording a lateral movement of the guide rails towards opposite sides from a middle position thereof.

In accordance with an additional feature of the invention, there are provided means for manually adjusting the guide rails laterally via a threaded spindle, the manual adjusting means having a detent latchable for fixing the guide rails in a given position, the detent being unlatchable for affording free movement of the guide rails in either lateral direction.

In accordance with a concomitant feature of the invention, the support is a horizontally freely movable support plate having crank-shaped guide lugs engaging in U-shaped guides on the guide rails for connecting the support plate and the guide rails so that they jointly perform a lateral movement.

Other features which are considered as characteristic for the invention are set forth in the appended claims.

Although the invention is illustrated and described herein as embodied in sheet feeder for rotary printing machines, it is nevertheless not intended to be limited to the details shown, since various modifications and structural changes may be made therein without departing from the spirit of the invention and within the scope and range of equivalents of the claims.

The constructions and method of operation of the inventions, however, together with additional objects and advantages thereof will be best understood from the following description of specific embodiments when read in connection with the accompanying drawings, in which.

Figure 1:
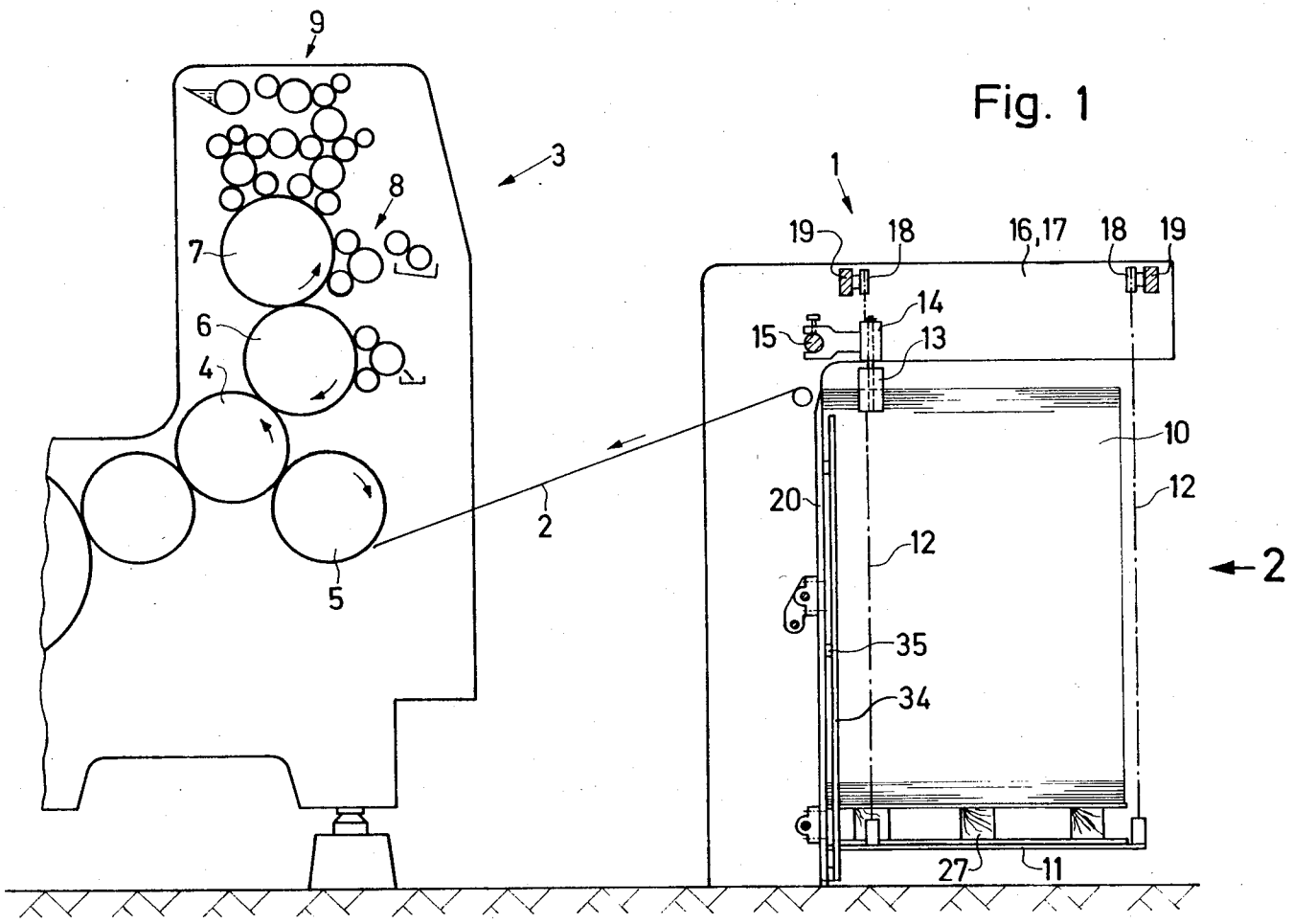
FIG. 1 is a diagrammatic side elevational view of a printing machine and a sheet feeder therefor.

Referring now to the drawing and first, particularly, to FIG. 1 thereof, there is shown a sheet feeder 1 which is connected in a conventional manner via a feed table 2 to a printing unit 3 of a rotary printing machine. In the illustrated embodiment of FIG. 1 there is provided an offset printing unit with an impression cylinder 4 which receives a sheet fed thereto by a feeder drum 5, a rubber or blanket cylinder 6 and a plate cylinder 7, with which a dampening unit 8 and an inking unit 9 are associated.

A sheet pile or stack 10 in the sheet feeder 1 is ordinarily disposed on a pallet 27 and is taken over by a support or carrier plate 11 which is suspended on four chains 12. The instant sheets are removed from the sheet-pile surface, the support or carrier plate 11 is automatically lifted so that the sheet-pile surface remains more-or-less at the same level. The individual sheets are taken off and transferred to the feed table 2 by a conventional, generally known device which is accordingly not illustrated in FIG. 1.

Stops 13 are provided for lateral alignment of the upper sheet layers, the stops 13 being vertically adjustably secured in holders 14. The holders 14 are laterally adjustably fastened to a cross bar 15 which is, in turn, fastened to lateral frames 16 and 17. It is thereby possible to adjust the stops 13 to any paper format which is to be processed and to a height or level corresponding to that of the sheet-pile surface. The device for automaticaly lifting the sheet pile 10 is well known in the art and acts directly upon the chains 12 which, in the illustrated embodiment of FIG. 1, are returned or reversed towards the lifting device via sprocket wheels 18 which are mounted on cross bars 19.

When a new sheet pile 10 is introduced into the sheet feeder 1, it is brought into contact with vertically disposed guide rails 20 in a forward or leading region of the sheet pile, as viewed in transport direction of the individual sheets and is simultaneously aligned. When laying-in or inserting the new sheet pile 10, the support or carrier plate 11 can execute a lateral movement. By the placement of the new sheet pile 10 with the forward or leading region thereof in contact with the guide rails 20, this lateral movement is, however, at least sharply braked if the guide rails have been immovably mounted.

Figure 2:
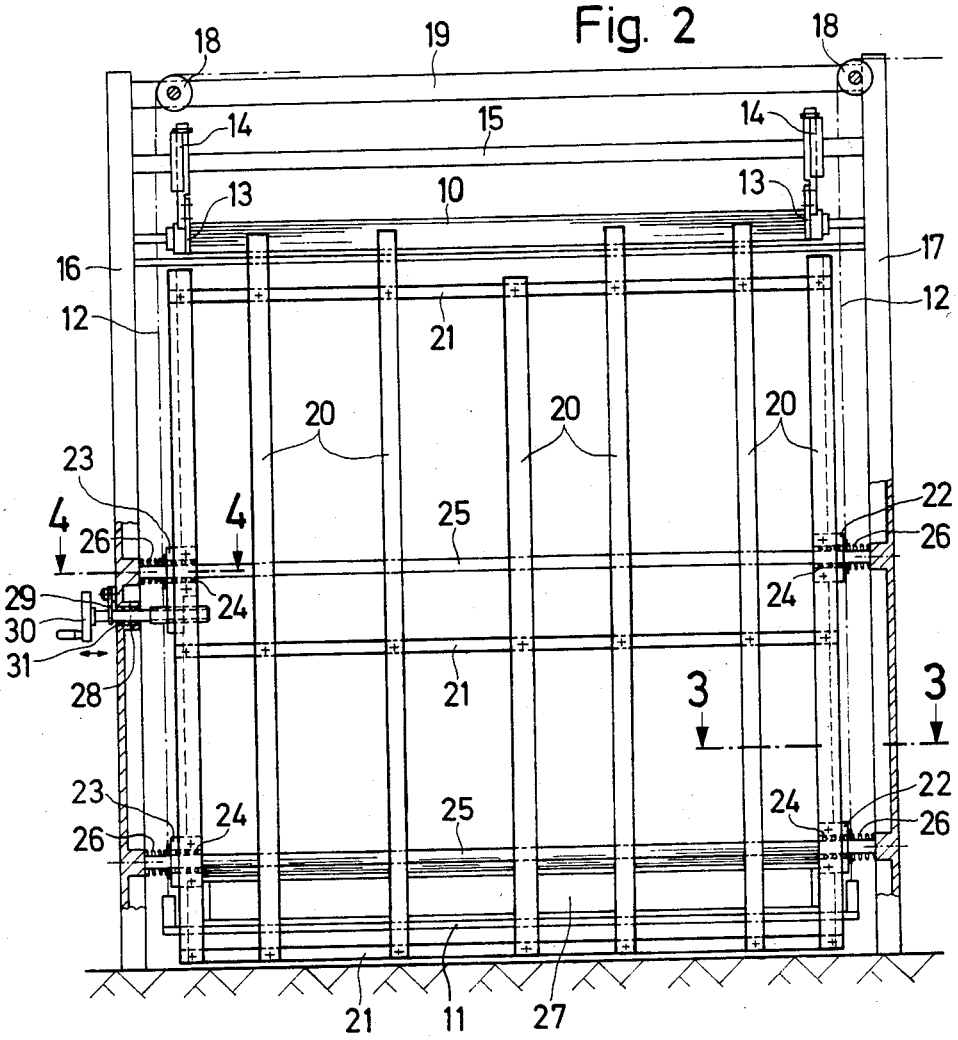
FIG. 2 is enlarged view of FIG. 1 as seen in direction of the arrow 2.

In the view of FIG. 2, it is apparent that the vertical guide rails 20 are connected to one another via strips 21 so that they form an intrinsically stable frame system. In this regard, each guide rail 20 is fastened to three strips 21, so that the entire frame system is laterally movable via bearings 22 and 23 and ball-bearing bushings 24 jointly on cross bars 25. This free mobility is limited laterally by weak stop springs 26. The latter, in turn, are disposed on the cross bars 25 which are mounted at both ends thereof, in lateral frames 16 and 17. The stop springs 26 move the frame system into a middle position thereof if no sheet pile has been inserted and limit the lateral movement of the frame system by forming blocks. The vertical guide rails 20, in case of a lateral movement of the sheet pile 10, can thereby follow this movement jointly with the support or carrier plate 11, without producing any discernible braking effect. The stops 13 are, consequently, in a position to align or orient the entire sheet pile 10, even if it is disposed, for example, obliquely or aslant, very minimal forces being sufficient for this purpose.

If the printer wishes to move the sheet pile 10 laterally by hand, for example, to orient or align the sheet pile, beforehand, with respect to the stops 13, he can manipulate a threaded spindle 28 provided with a detent 29 which engages with the bearing 23. When the detent 29 is inserted into a recess formed in the threaded spindle 28, the latter may be turned by means of a handwheel 30, so that the vertical guide rails 20 and the sheet pile 10 therewith are moved laterally. If the detent 29 is then raised, the threaded spindle 28 in its bearing may follow freely, via ball-bearing bushings 31, lateral movement of the sheet pile 10.

Figure 3:
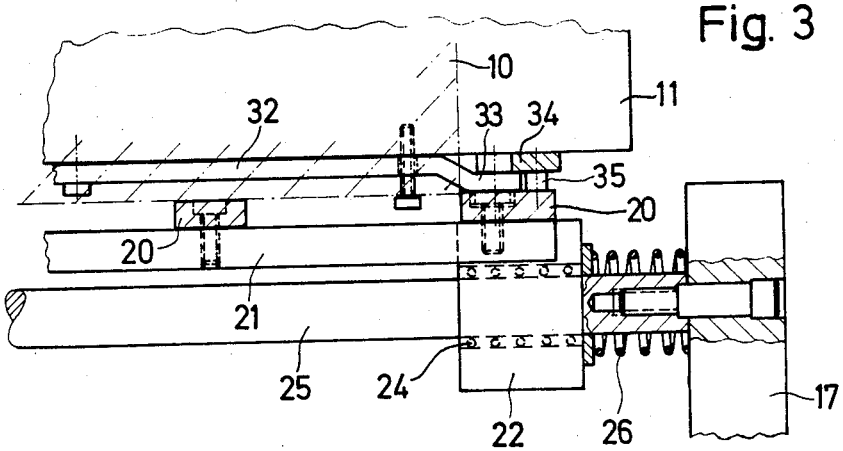
FIG. 3 is a fragmentary, enlarged sectional view of FIG. 2 taken along the line 3—3 in direction of the arrows.

In the fragmentary sectional view of FIG. 3, the support plate 11 is provided, in a further clarification of the invention, with a U-shaped guide or guide strip 32 having an offset or cranked portion 33 at the outer guide rails rail 20. The end of the cranked portion 33 is embraced by a guide rail 34 which is fastened by bolts 35 to each of the outer guide rails 20 (FIG. 1). The guide rail 32 is resiliently fastened to the support plate 11 so that, during upwards and downwards movement, the sheet pile can be adjusted in travel direction of the sheets. Due to this connection between the support plate 11 and the guide rails 20, the lateral movement between both elements is synchronized, which has an especially advantageous effect, whenever a sheet pile of relatively low height is placed thereon, and this sheet pile is to be manually adjusted or oriented with respect to the stops 13 by the handwheel 30.

Figure 4:
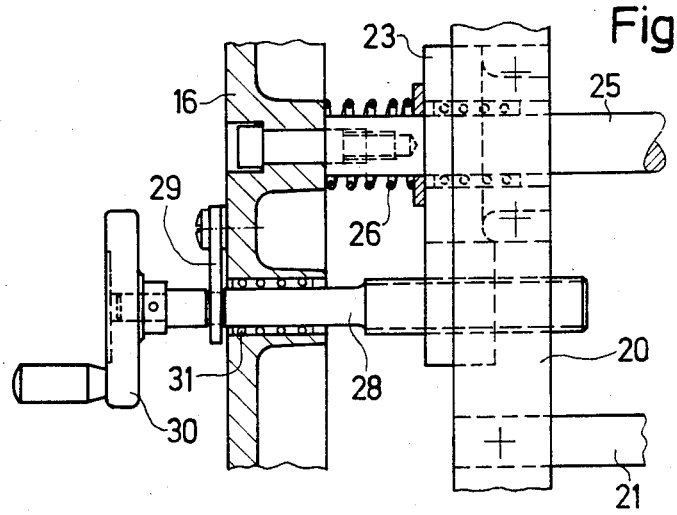
FIG. 4 is a fragmentary, enlarged sectional view of FIG. 2 taken along the line 4—4 in direction of the arrows.

In FIG. 4, the lateral manual adjustment by means of the handwheel 30 is depicted in a fragmentary enlarged view of FIG. 2, in order to show the structural details more clearly. In this regard, it should be noted that the frame system of the guide rails 20, jointly with the support plate 11, adjusts or orients itself by middle-centering into the middle position, when the detent 29 is not inserted, prior to the introduction of a new sheet pile.

Figure 5:
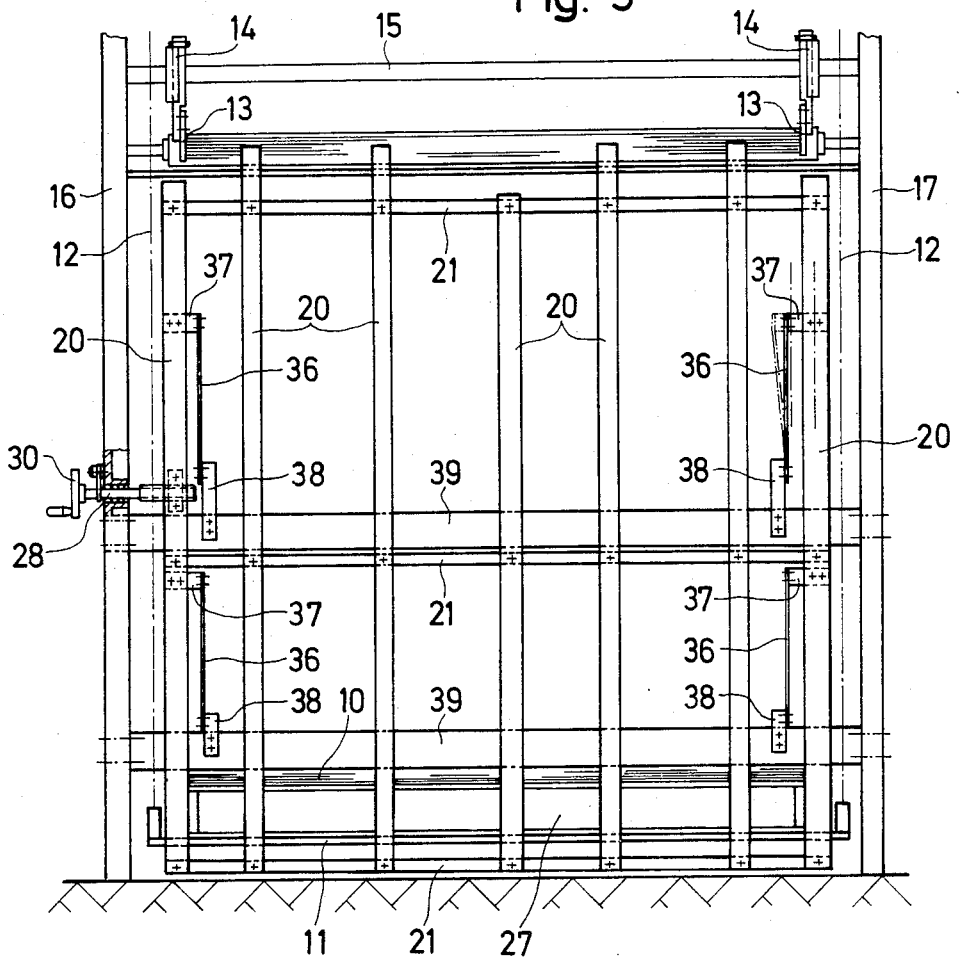
FIG. 5 is a view similar to that of FIG. 2 showing a different embodiment of the invention.

The embodiment of the invention shown in FIG. 5 differs from the aforedescribed embodiments in that the frame system with the guide rails 20 and the strips 21 is not mounted via ball-bearing bushings 24 on cross bars 25, but rather, also, leaf springs 36 are fastened by straps 37 to the outer guide rails 20 in such a manner that the straps 37 engage with the upper end of the vertically disposed leaf springs 36. Pillow blocks 38 are provided at the lower end of the leaf springs 36 and are disposed on the rails 39 fastened in the lateral frames 16 and 17. The leaf springs 36 permit a lateral movement of the frame system with the guide rails 20 due to the fact that they are disposed perpendicularly to the frame system. The width of the leaf springs thus prevents a movement perpendicularly to the guide rails 20. The movement to the leaft-hand side in FIG. 5 is represented in phantom at the right-hand upper end of the leaf spring. After a total of four leaf springs engage with the frame system, the lateral movement of the guide rails 20 occurs parallel to both sides. In the starting position, the leaf springs 36 adjust or orient the frame system with the guide rails 20 automatically in a middle position thereof. This configuration is especially economical and offers the same advantages as those described hereinbefore, a manual adjustment by means of the handwheel 30 being possible. Also, the adjustment force which is to be applied by the stops 13, in this configuration, is very small, so that a sheet pile with uneven lateral edges is reliably adjusted or straightened-out and can be fed in a precise manner to the printing unit.

There are claimed:

1. Sheet feeder for rotary printing machines having a horizontally movable support for a sheet pile, stops for laterally adjusting the sheet pile and vertically disposed guide rails in a forward region of the sheet pile for engaging the leading edge of the sheets, comprising means for mounting the guide rails so that they are freely movable laterally, and automatically follow a movement of the sheet pile, including strips connecting the guide rails to one another, the guide rails and said strips being jointly mounted via ball-bearing bushings on cross bars extending from side-to-side of the sheet feeder, and stop springs mounted on said cross bars at both ends thereof.

2. Sheet feeder for rotary printing machines having a horizontally movable support for a sheet pile, stops for laterally adjusting the sheet pile and vertically disposed guide rails in a forward region of the sheet pile for engaging the leading edge of the sheets, comprising means for mounting the guide rails so that they are freely movable laterally, and automatically follow a movement of the sheet pile, including strips connecting the guide rails to one another, and vertically extending leaf springs having an upper end at which the guide rails and said strips are jointly mounted, said leaf springs being fastened at respective lower ends thereof via pillow blocks to a frame of the sheet feeder and affording a lateral movement of the guide rails towards opposite sides from a middle position thereof.

3. Sheet feeder for rotary printing machines having a horizontally movable support for a sheet pile, stops for laterally adjusting the sheet pile and vertically disposed guide rails in a forward region of the sheet pile for engaging the leading edge of the sheets, comprising means for mounting the guide rails so that they are freely movable laterally, and automatically follow a movement of the sheet pile, including means for manually adjusting the guide rails laterally via a threaded spindle, said manual adjusting means having a detent latchable for fixing the guide rails in a given position, said detent being unlatchable for affording free movement of the guide rails in either lateral direction.

4. Sheet feeder for rotary printing machines having a horizontally movable support for a sheet pile, stops for laterally adjusting the sheet pile and vertically disposed guide rails in a forward region of the sheet pile for engaging the leading edge of the sheets, comprising means for mounting the guide rails so that are they freely movable laterally, and automatically follow a movement of the sheet pile, the support being a horizontally freely movable support plate having crank-shaped guide lugs engaging in U-shaped guides on the guide rails for connecting the support plate and the guide rails so that they jointly perform a lateral movement.

* * * * *